US005079938A

United States Patent [19]

Schwarz

[11] Patent Number: 5,079,938

[45] Date of Patent: Jan. 14, 1992

[54] PROCESS AND APPARATUS FOR PRODUCING A HELICALLY SEAMED PIPE

[76] Inventor: Walter Schwarz, Lindenbühelweg 12, A-6020 Innsbruck, Austria

[21] Appl. No.: 474,799

[22] PCT Filed: Nov. 23, 1988

[86] PCT No.: PCT/AT88/00100

§ 371 Date: Jun. 5, 1990

§ 102(e) Date: Jun. 5, 1990

[87] PCT Pub. No.: WO89/05201

PCT Pub. Date: Jun. 15, 1989

[30] Foreign Application Priority Data

Dec. 10, 1987 [AU] Australia ..... 3245/87

[51] Int. Cl.[5] ..... B21C 51/00; B21C 37/12

[52] U.S. Cl. ..... 72/34; 72/49; 29/407

[58] Field of Search ..... 72/49, 50, 34, 135, 72/138; 29/407; 228/56.5, 17.7

[56] References Cited

U.S. PATENT DOCUMENTS 4,287,739 9/1981 Campbell ..... 72/34
4,615,094 10/1986 Kai et al. ..... 29/407

FOREIGN PATENT DOCUMENTS 2832508 2/1979 Fed. Rep. of Germany ..... 72/49
3500615 1/1985 Fed. Rep. of Germany .
192617 11/1983 Japan .

*Primary Examiner*—Lowell A. Larson
*Assistant Examiner*—Michael J. McKeon
*Attorney, Agent, or Firm*—Hale and Dorr

[57] ABSTRACT

Disclosed is a process and apparatus for producing helically-seamed pipes of any cross-sectional shape. The pipe is produced from a flat strip of material marked at intervals that are a derivative of the circumference of the pipe. At least two sensors are arranged at check points along a paraxial line in order to identify any deviation of the marks from the axis and to generate mark-recognition signals. If the signals are emitted simultaneously, the circumference is constant, and if there is a time differential between the signals, correction is needed.

13 Claims, 7 Drawing Sheets

PROCESS AND APPARATUS FOR PRODUCING A HELICALLY SEAMED PIPE

Figure 1:
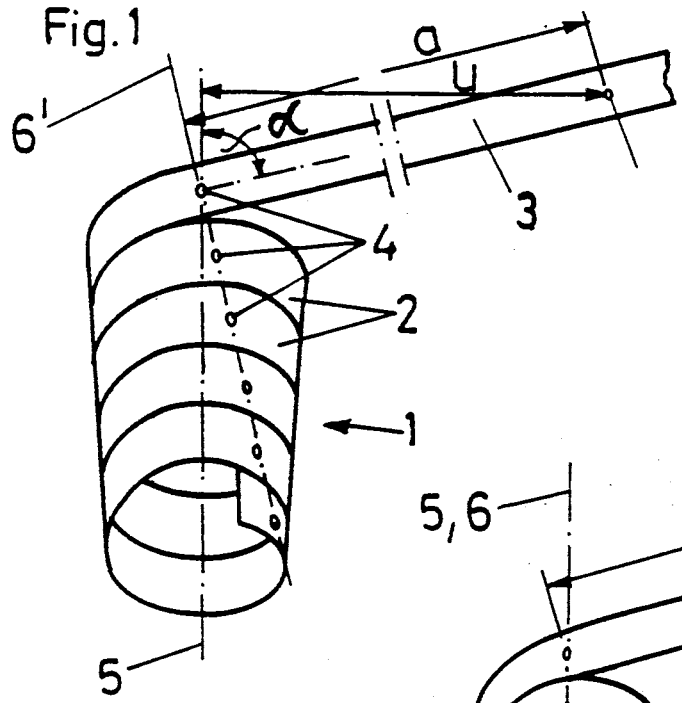

The present invention relates to a process for producing a helically-seamed pipe from a flat band of material that is fed in at angle to the pipe, marked and wound, any deviation from the nominal value of the circumference length being detectable by changing relations of mark positions so that a corrective procedure can be initiated.

Problems connected with maintaining the correct diameter of the pipe can arise when such pipes are helically wound without the use of a core, from a strip of material, and the edges of the strip are joined continuously with each other. These problems arise sometimes when the diameter of the cross-sectional area of the first winding is being determined; this is generally bent by hand, when a section of the strip of material that is of equal length to the length of the circumference of the desired pipe is fed through the winding rollers, bent to form a loop, and then the beginning is passed once again to the bending or joining rollers. It is extremely difficult to establish the diameter of the pipe accurately in this way, since only in the rarest cases, when cylindrical pipes are involved, is the first, hand-bent loop of a circular cross-section, or of the desired angular cross-section area when angular pipes are involved.

In the same way, however, it is also extremely difficult to maintain the desired circumference length. If the long edges are seamed, for example, one long edge may have a bent web and the other may have a U-shaped fold, these being guided into each other, the connector rollers folding and flattening the seam. This causes an offset of the material sections of between 0.7 and 1.3 mm per winding. The reasons for the resulting inaccuracies may be that the folded web of the section of the material strip that bends undergoes a stretching that increases radially, and this can only be partially compensated by upsetting when the seam is bent, since the folded web within the bent seam comes to rest at a distance from the outer surface of the last winding that equals the thickness of the strip of material, since it is encompassed by the U-shaped seam. For this reason, the length of the U-shaped seam is approximately equal to the length of the stretched web, so that the diameter of the pipe increases with each winding. A number of possibilities to eliminate these deficiencies have already been suggested for cylindrical pipes. For this purpose, for example relations of mark positions are controlled (U.S. Pat. No. 4,287,739, U.S. Pat. No. 2,301,092 and JP-A-58/192617). According to U.S. Pat. No. 4,287,739 a sheet metal strip is at each edge provided with a number of marks being spaced from each other by the same distance which is chosen at random. When the strip is being wound, the distance which results between a mark of the one edge and a mark of the other edge of the preceding winding should not change when the circumference length is constant. It cannot be seen directly if the constant circumference length corresponds to the desired circumference length. Occuring changes in the distance are recognized by the operators, whereupon suitable corrective procedures can be initiated. U.S. Pat. No. 2,301,092 and JP-A-58/192617 also use two rows of marks at constant distances which are chosen at random, in these cases the additional criterium is set that at the distance of the desired circumference length from each mark at the one strip side a mark is provided at the other strip side. Hence, during the winding process the marks of the one edge coincide with the marks of the other edge of the preceding winding only if the circumference length corresponds to the desired circumference length and if the circumference length is constant. In this case, too, changes are recognized by the operators so that corrective steps can be taken. Problems arise in connection with arranging and comparing adjacent edge marks, when the windings are seamed, since the marks may become unrecognizable through the seam formation and, moreover, they may move for the reasons mentioned at the beginning of this specification without the actual occurence of circumference changes.

U.S. Pat. No. 3,217,402 uses substantially the same method. In this case, too, the marks of the two rows are spaced by the circumference length, each, the constant distance between the marks in each row corresponding however to a value which results from the circumference length taking into consideration the feed angle of the strip. This allows to provide the two strip edges with teeth which engage each other in the winding process, and the toothed helical seam is welded. Circumference changes are eliminated by the toothing but a toothing device must be associated with both edges of the strip, and it is not possible to apply the winding process in connection with seamed pipes.

In a process for the production of cylindrical pipes, known from DE-A 3 324 463, supporting rollers are used within the resulting winding, and these contain pressure-measuring devices. A reduction of the diameter increases the pressure that acts on the rollers, and an increase in the diameter reduces the pressure. The pressure readings are compared with a nominal value that corresponds to the desired length of circumference by an electronic control unit, and the pressure of the bending rollers is varied. Other known corrective measures that can be applied during the coreless production of cylindrical, helically-seamed pipes relate to changing the edge bending of the strip (DE-A 3 137 858) or changing the feed angle (DE-A 3 500 615).

DE-B-2832508 describes an apparatus for producing tubes which shall have at a part of the circumference longitudinal rows of holes which are parallel to the axis and serve for the directed exit of air. Since the perforation in the flat band of material results, in view of the inevitable changes in circumference, in displacements of the holes so that the holes do not lie in generatrices of the tube but, for example, in helical lines, it has been suggested to arrange at the circumference of the tube a hole template of annular shape and to determine during each rotation the arrangement of the holes by means of a sensor which also moves in the longitudinal tube direction. The generated signals effect perforation of the flat band. Not only the constancy of the circumferential length is obtained by this process but also an accumulation of errors per winding is avoided. A row of holes which is exactly parallel to the axis is obtained, when the error per winding remains constant. If the error varies, only slight deviations occur so that the air exit directions vary within a narrow angular range. U.S. Pat. No. 3,739,459 describes a process for producing columns with longitudinal reinforcing ribs, a parallelogram-shaped metal plate with transverse ribs being wound and welded along the seam. An exact circumferential control is easily possible since the ribs are in alignment at the column. In this winding process, too, the relation between the position of two marks at the contiguous edges is controlled so that essentially the same process as describes in U.S. Pat. No. 2301092 and JP-A-58/192617 is applied.

It is the task of the present invention to facilitate a process of the type described in the introduction hereto, and in particular making it possible to produce helically-seamed pipes of any cross-sectional shape.

According to the invention, this has been done in that on the band of material, at distances which correspond to the angle-dependent increased circumference of the pipe, a single row of marks is provided which lie on the resulting pipe in at least one aligment line that is parallel to the axis, when the circumference length of each winding corresponds to the nominal value of the circumference, that each mark is passed through a stationary checking field which is associated with the resulting pipe, and that each time difference between two mark recognition signals which deviates from a nominal value is used to initiate a corrective procedure.

In the process according to the invention, only a single row of marks is made on the strip which may have any position or any distance from the edge. Thus, the marks may be arranged in such a manner that they do not pass through the winding and seam forming device and will therefore not be destroyed by said devices. Furthermore, one marking device is saved. The detection of changes is not made by checking the direct positional relation between a moving mark and a second mark but between a stationary checking device and the marks passing said checking device. Checking of the alignment line can also take place repeatedly within a circumference length. This has the advantage that deviations are detected more rapidly and corrective measures act more directly.

The process according to the present invention is therefore suitable for cylindrical pipes as well as for angular pipes. In the latter, by dividing the circumference length into the corresponding side lengths, the distances between the marks can also be matched to the side lengths, so that the constancy of these can be monitored individually. As discussed, the corrective procedures can be of any kind and can lead, for example, to a change in the pressure of the bending rollers, to a change in the angle between the strip intake plane and the axis of the pipe, to slewing the strip intake in the plane, and in the case of folded seams, to a change in the seam former.

Each corrective measure can start from a zero or middle position that corresponds to the nominal value, so that a change in the circumference length has to effect a positive or a negative corrective process. This may make the constructional configuration and/or the control of the corrective means difficult or complex. For example, the rotation of adjusting elements would require a right-hand and left-hand drive system.

A preferred embodiment of the present invention foresees that the pipe is wound with a circumference length that differs from the nominal value by an amount of tolerance, so that the marks deviate from the alignment line only on one side, the found time differences initiating corrective processes that in each instance are effective exclusively in the same direction. This means that the pipe is wound so as to be too big or too small, which will depend mainly on the type of helical seam that is used. Because of the heating that is involved, welded helical seams tend to increase the circumference, and in the case of folded helical seams, the change in circumference will depend on the formation of the seam; reductions and increases are known. If the nominal value of the circumference length that has been set thereby corresponds to one of the two limiting values of the tolerance range, this will result in a pipe of constant circumference at the maximal deviation that occurs, that requires no correction. For this reason, for the case of maximal deviation, the corrective means can be arranged in a basic position, since a negative adjustment does not occur. If there is no deviation, corrective measures are implemented and if the deviation takes place towards the other limiting value, more rigorous corrective measures are implemented. Thus, only a simple drive is required to rotate the adjusting element, as discussed above, since there is no need to change the direction of rotation. In order to identify any deviation, a time difference, which deviates from the nominal value zero, between the mark recognition signals of two paraxially aligned check points of the stationary checking field can be determined. If the circumference remains constant, the signals will be emitted simultaneously. If there is a time difference between the signals, there is a change in circumference. A check of the alignment lines for the marks, carried out in this manner, is independent on the length of the circumference, but requires sensitive checking instrumentation in order to be able to identify very small time differences.

The corrective procedures can be implented only in the interval between mark signals, their duration thus corresponding to the time differences and thus directly to the change in circumference. In the case of corrective measures that change the application pressure of bending or seam-forming rollers or the position thereof, a duration of correction that lies only in the interval will not be sufficient to achieve the desired result. For this reason, the corrective measure is initiated when only one of the two mark-recognition signals is present, and preferably maintained until the next mark-recognition signals are emitted. If these are emitted simultaneouly, the corrective measure is cancelled. If, on the other hand, an interval is still perceived, the corrective measure is either maintained or intensified.

Another possibility for carrying out the process is that a deviation from a prescribed nominal value of the time difference between two mark-recognition signals of a signal check point of the stationary checking field is determined, the prescribed nominal value being defined by the circumference nominal value. Here, there is a dependency on the circumference length, and the comparison between the signals from two check points is eliminated. Mark-recognition signals can be generated, for example, by changes in the reflection from light waves that impinge on the marks. Another possibility is that each mark-recognition signal is generated by scanning a modified surface property. This last method can be used, in paricular, with impressed marks.

In order to produce a helical-seam pipe of the type described in the introduction hereto, an apparatus is used that is provided with a guide table for the incoming band of material which has a marking device, with a winding apparatus that comprises a pipe guide and, in particular, bending rollers, and with means for initiating corrective procedures, if the circumference length of the resulting pipe changes. The process according to the present invention can then be carried out with such an apparatus if the guide table has an apparatus for the variable adjustment of the distance between the marks, and if at least one checking system for emitting mark-recognition signals is provided in the area of the pipe guide of the winding apparatus, and if for the recognition of changes in the circumference length a device for the detection of a time difference between two mark-recognition signals is provided, the means for initiating the corrective procedures being associated with said device. It is preferred that a sensor that can be moved along the strip of material be used for adjusting the distance between two marks, said sensor effecting the formation of the next mark by the marking apparatus, when a mark is identified.

Figure 2:
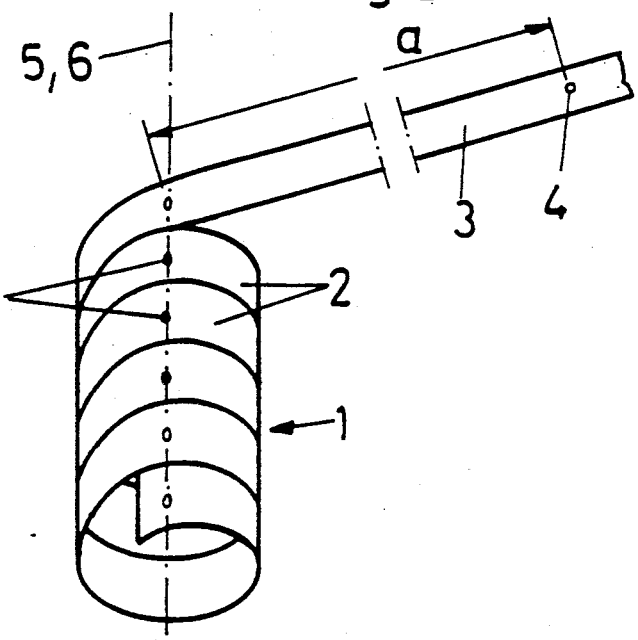
Figure 3:
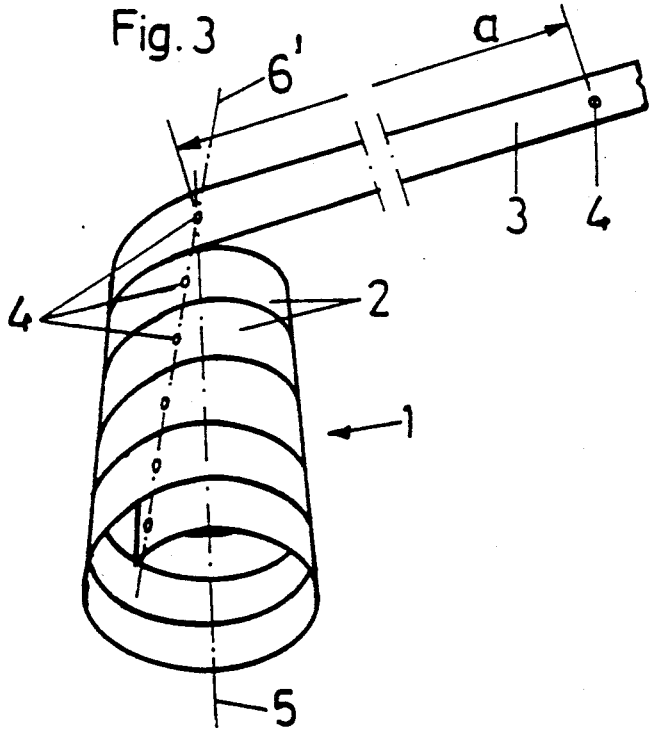

In a preferred embodiment, the checking system comprises at least two check points arranged in the area of the pipe guide on a paraxial aligment line and spaced from each other by the breadth of the strip of material. The arrangement of these will depend on existing space that is available, and can be either inside or outside the pipe, on any position on the circumference. The present invention will be described in greater detail below on the bais of the drawings appended hereto, without being restricted thereto. These drawings are as follows:

FIGS. 1 to 3: Views of three angle processes in the production of a pipe with a round cross-sectional area.

Figure 4:
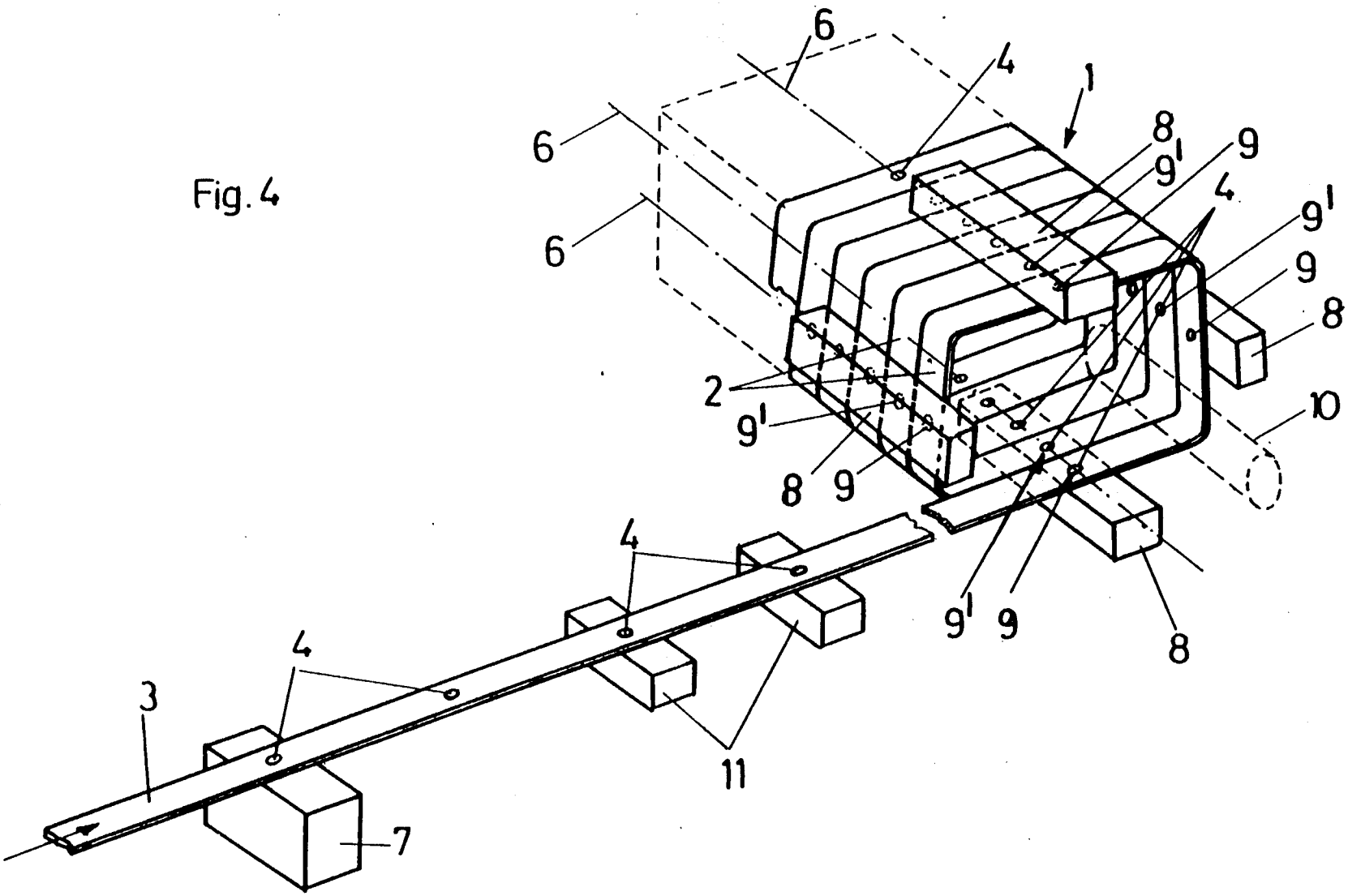

FIG. 4: A diagrammatic oblique view of a winding apparatus for producing pipes with an essentially rectangular cross-section.

Figure 5:
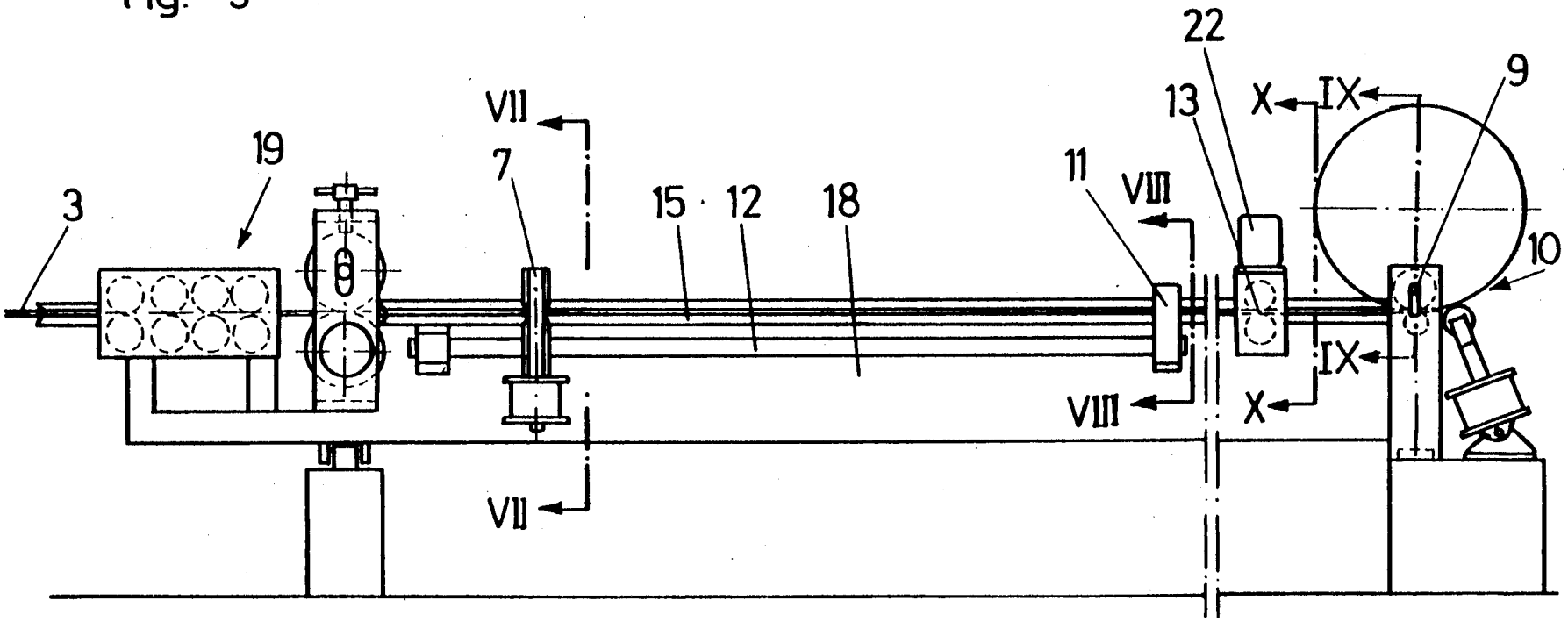

FIG. 5: A side view of an apparatus according to the present invention.

Figure 6:
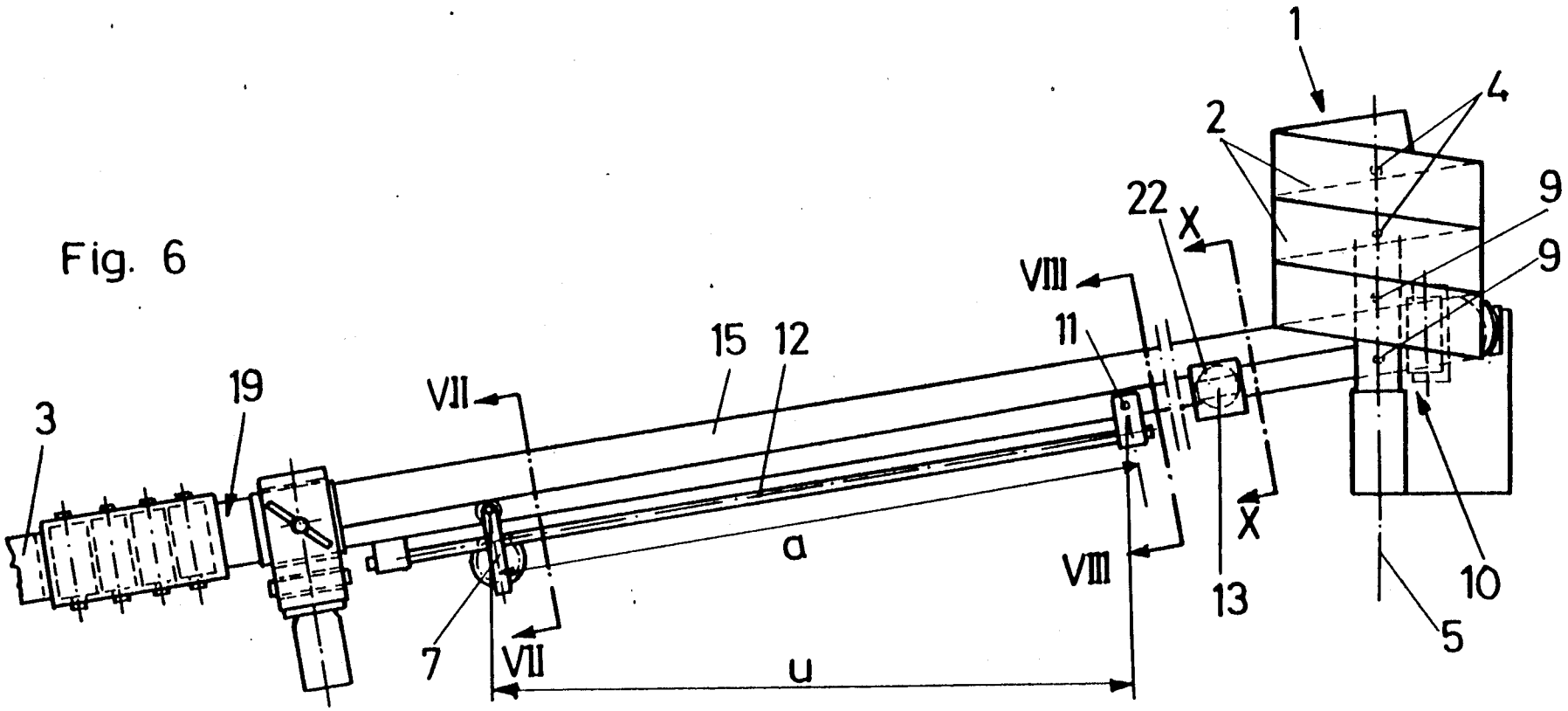

FIG. 6: A plan view of the apparatus in FIG. 5.

Figure 7:
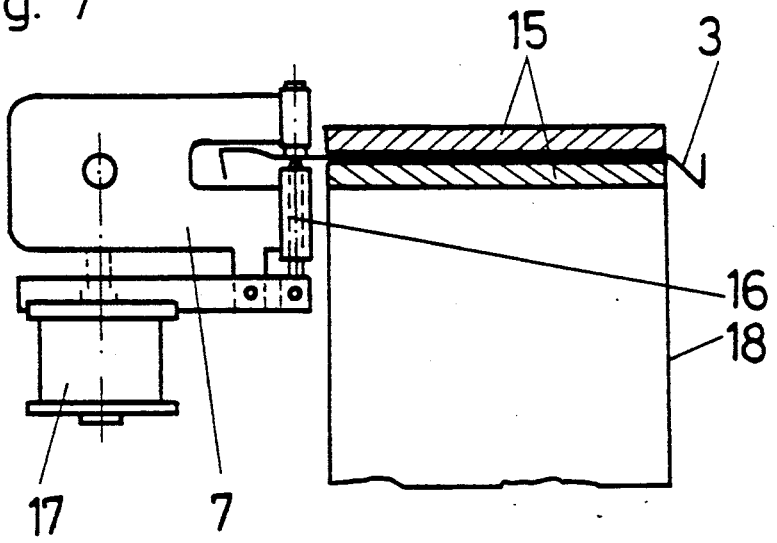

FIG. 7: A cross-section on the line VII—VII in FIG. 5 or 6.

Figure 8:
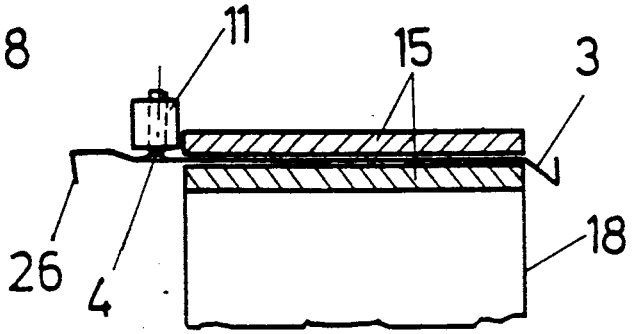

FIG. 8: A cross-section on the line VIII—VIII in FIG. 5 or 6.

Figure 9:
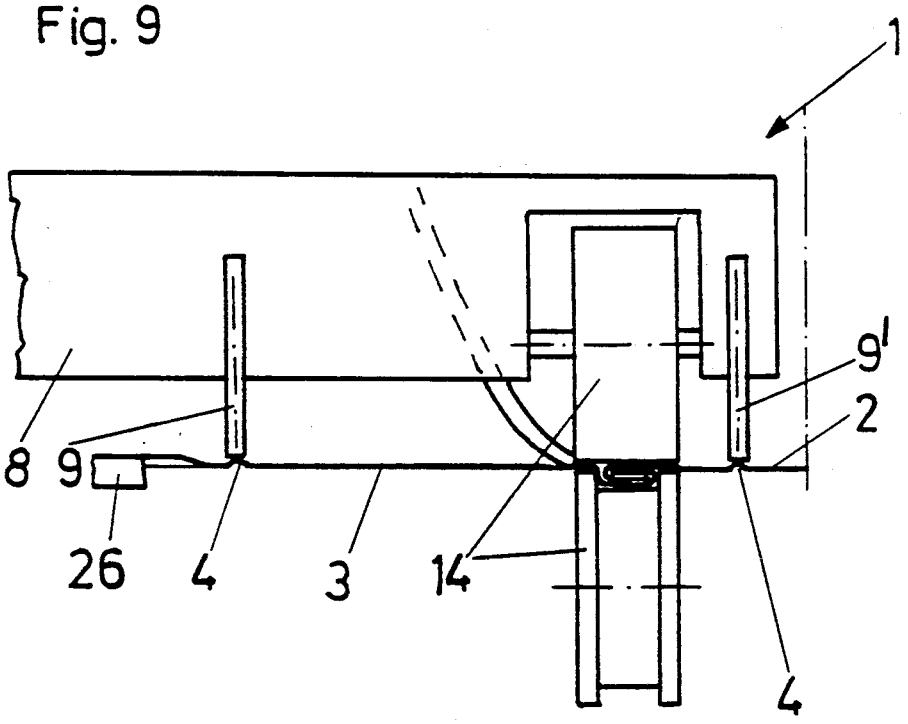

FIG. 9: A cross-section on the line IX—IX in FIG. 5.

Figure 10:
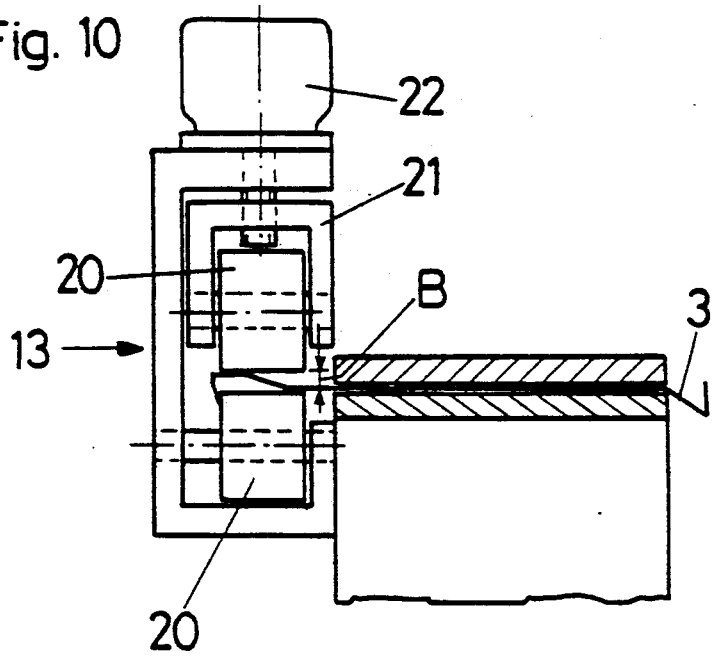

FIG. 10: A cross-section on the line X—X in FIG. 5 or 6, the basic position of two rollers to implement a corrective measure.

Figure 11:
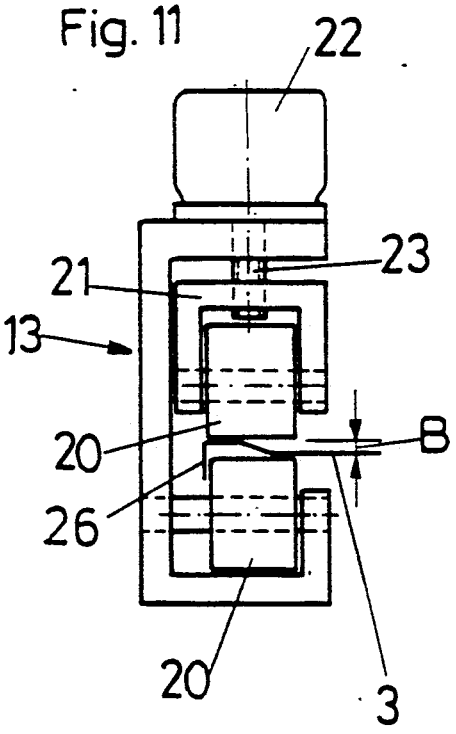
Figure 12:
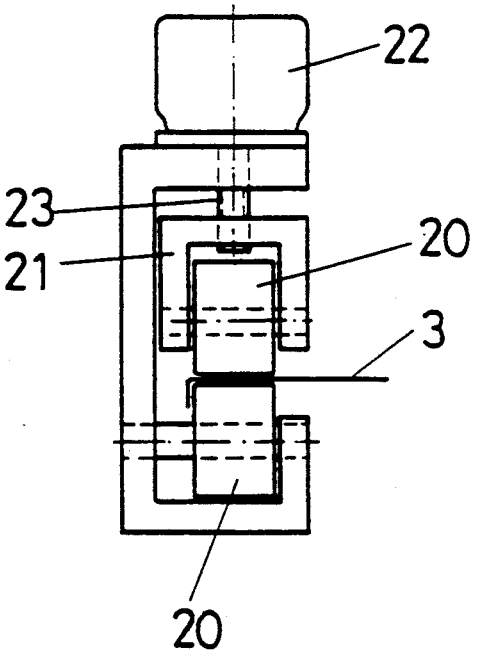

FIGS. 11 and 12; Diagrams as in FIG. 10, with the position of the two rollers changed.

Figure 13:
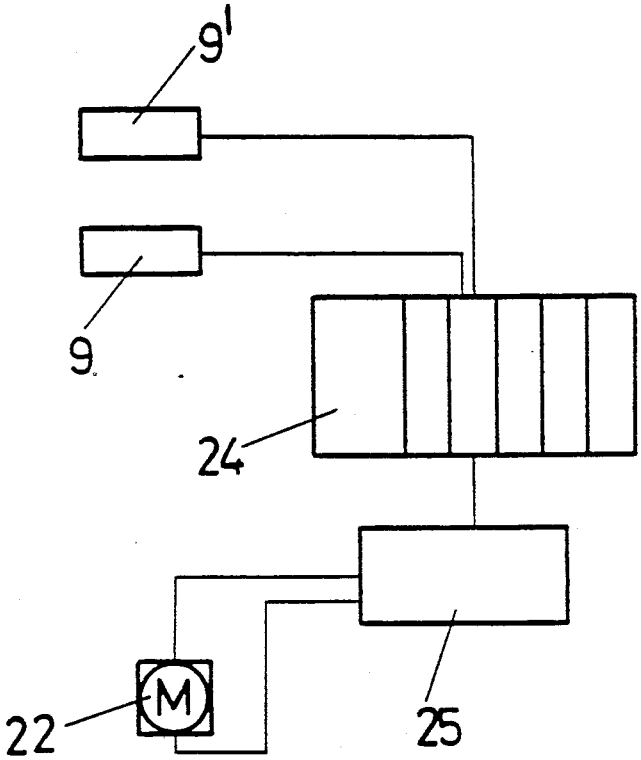

FIG. 13: A diagram of the control of the servomotor shown in FIGS. 10 to 12.

FIGS. 1 to 3 illustrate the mathematical principles that form the basis of the present invention. Assuming a precisely cylindrical pipe 1 is to be wound, the length of its circumference is obtained from the formula $u=d\pi$, this value representing a side of a right-angle triangle in view of the feed angle $\alpha$ of the band of material 3 to the axis 5 of the tube, which is dependent on the diameter d of the pipe and the width of the band of material, the hypotenuse of said triangle being equal to the distance a between two marks 4. Thus, its length is calculated from the formula $$a = \frac{u}{\sin \alpha}$$

Thus, as is shown in FIG. 2, when the diameter of the winding is constant, the marks 4 will lie on an alignment line 6 that is parallel to the axis 5 of the pipe. Should the circumference of the pipe become constantly greater or smaller, then the alignment line 6' will no longer be parallel (FIG. 1 and FIG. 3). Should the change in the circumference vary in a manner that is not constant, there will be no alignment line 6,6'.

These mathematical foundations that apply to the present invention will now be shown schematically in FIG. 4, for the production of a pipe that is of essentially rectangular cross-section. A strip of material that is advanced with the help of a feed and, optionally, a bending press 19 is fed into a winding apparatus 10, of which only one inside bending core is shown. At a distance ahead of the bending press 9 that is less than the smallest side dimension of the pipe 1 that is to be produced, there is a checking device 8 beneath the strip 3 of material or the pipe 1; this checking device 8 has two check points 9, 9' on an alignment line 6 that is parallel to the axis 5 of the pipe. If, for structural reasons, it is impossible to install the checking device 8 at this point then, as is shown in FIG. 4, it can be installed at any other point to one side of and outside the pipe 1. At a distance, preferably at least equal to the circumference, ahead of the first check point 9 there is a marking apparatus 7 that produces marks 4 on the underside of the band 3 of material. The marking apparatus can incorporate a punch, a stamp, a paint sprayer or the like, and is activated when a previously made mark passes a sensor in an interval-adjusting apparatus 11 that can be moved along the strip of material 3 or the first check point 9, so that the distance a between the marks 4 is equal to the length of the circumference or a part of the length of the circumference, according to the formula given above. Each mark 4 that passes the first check point 9 migrates around the circumference of the pipe as said pipe is being wound, and finally passes a second check point 9' in the same checking device 8. Then, the marking signals of both check points 9, 9' occur simultaneously if the length of the circumference of the last winding 2 is equal to the circumference of the pipe. If, however, the pipe is larger, then the first check point 9 picks up the signal earlier than the second check point 9'; if the pipe is smaller, the first check point picks up a signal later than the second check point. The checking device 8 can emit a beam of light at each check point 9,9', for example; then, if the mark is in the form of a hole, when this passes the light will not be reflected or, if the mark is in the form of a patch of paint, the reflection will be weaker. If the mark 4 is impressed, there will also be a change in the reflection, although it will also be possible to scan the surface of the strip 3 of material and sense the impression.

Particularly in the case of a pipe 1 of angular cross-section, it may be necessary to ensure that not only the circumference, but also the length of the sides remain constant, in order to generate angular pipes that are not twisted. Mainly for such a case, a plurality of checking devices 8 can be distributed within the system. Then, for each winding 2, the marks 4 pass through a plurality of first check points 9 and then through a plurality of second check points 9', when in each instance it will be possible to identify deviations because of the time differential that will occur. If, as has been discussed above, the distance between the marks 4 is reduced and matched to the circumference distances of the checking system 8, then in each instance the signals from a plurality of checking devices 8 can be compared as to their identical timing and evaluated for the purpose making corrections. In particular, in the case of a repeated checking per circumference length, it is possible to associate one or a plurality of sensors for detecting the marks 4 to each distance-adjusting apparatus 11.

FIGS. 5 and 6 show an apparatus that is used for winding round pipes that are joined by a seam. The band 3 of material that is drawn off a spool passes through a feed and seam-forming machine 19, in which the edge formation shown in FIGS. 7 and 8 is imparted to the metal band 3. After the seam-forming machine 19, the band 3 of material passes between the guide plates 15 of a guide piece 18. A guide track 12 on which the marking apparatus 7 is installed, extends parallel to the guide plates 15. As is shown in FIG. 7, this marking apparatus incorporates a stamp 16 that marks the underside of the strip 3 of material and is actuated by a solenoid 17.

At the other end of the guide track 12 there is the distance-adjusting apparatus 11 that incorporates a sensor to detect the marks 4 (FIG. 8). The distance a between the marking apparatus 7 and the interval-adjusting apparatus 11 can be varied and is based on the length u of the circumference as set out in the formula given above.

Between the distance-adjusting apparatus 11 and the winding apparatus 10 there is a pair of rollers 20 as the means 13 to correct deviations for the calculated circumference length u. As can be seen in FIGS. 10 to 12, the two rollers 20 are rotatably supported on a mounting and overlap that longitudinal edge area formed and bent in the seam-forming apparatus 19, next to which the marks 4 are stamped and which includes the inner seam strip 26 that lies within the closed seam as in FIG. 9. The long edge area is thus first offset upwards by the dimension B and the adjacent seam strip is folded down. The upper roller 20 is supported in a mounting 21 that is arranged on a threaded spindle driven by a servomotor 22 that is installed on the mounting, so that dimension B between the rollers 20 can be varied by said motor 22. The strip of material that enters the winding apparatus 10 is shaped by bending and seaming rollers 14, and seamed, as can be seen from FIG. 9. As can be seen in FIG. 13, an electronic system 25 with a freely programmable control system 24 processes the signals from the check points 9,9' and controls the servomotor 22 that varies the distance B between the rollers 20 as in FIGS. 10 to 12, this resulting—in the position shown in FIG. 10—in a pipe of the smallest diameter, and—in the position shown in FIG. 12—in a pipe of the greatest diameter, since the distance of the edge area that supports the seam strip 26 to the axis 5 of the pipe, which is not centrally guided, is varied.

A pipe that has been folded as in FIG. 9 is inclined to increase in diameter, this resulting in a shape that is shown to an exaggerated extent in FIG. 1. If the pipe 1 is now rolled at a circumference length that has been reduced from the nominal value by the amount of the tolerance, the marks 4 will wander off to one side of an alignment line that is parallel to the axis of the pipe, on which they lie only at maximal automatic oversizing. In this case, the dimension B is set at the maximum (FIG. 10). If too small an enlargement is noted by the check points 9,9' because of a deviation, the servomotor 22 is activated through the control system 24 and the electronic system 25, the reduction increasing on the basis of the time differential between the mark recognition signals. A small time differential will, for example, generate a small reduction of the dimension B shown in FIG. 11, whereas a maximum time difference will lead to the complete flattening of the edge strip as in FIG. 12. Thus, the tendency of a pipe 1, started too small, to enlarge is supported to the extent that leads to the desired circumference, on the basis of time differentials in the mark-recognition signals. The dimension B set in each instance between the rollers 20 remains unchanged if the next signal pair is passed simultaneously to the electronic system 25; in contrast to this, a further adjustment is made if there is a time differential. Only the need to increase the diameter of the pipe is given by the association of the basic position of the rollers 20 to a limiting value of the increasing deviations of a pipe that is too small, whereby a simpler servo drive can be achieved. A corrective measure that involves a reduction of the dimension B thus always moves in a positive range that begins with the basic Position shown in FIG. 10, although this must never be reversed.

However, one check point 9 would also be sufficient, which then makes a comparison between a given, nominal value for the time differential between two mark-recognition signals, which depends on the length of the circumference and the feed rate, and their actual values. This Process can be used at a Plurality of check points 9, 9' or be superimposed on the process described above.

I claim:

1. A process for the production of a helically-seamed pipe (1) from a flat band of material (3) that is fed at an angle ($\alpha$) to the pipe (1), marked and wound, any deviation from the nominal value of the circumferential length being detectable by changing relations of positions of marks (4) so that a corrective procedure can be initiated, wherein on the band of material (3) , at distances (a)which correspond to the angle-dependent increased pipe circumference (u), a single row of marks (4) is provided which lie on the resulting pipe (1) in at least one alignment line (6) that is parallel to the axis, when the circumference length of each winding corresponds to the nominal value of the circumference, wherein each mark (4) is passed through a stationary checking field which is associated with the resulting pipe (1) and generates a mark-recognition signal, and wherein each time difference between two mark-recoginition signals which deviates from a nominal value is used to initiate a corrective procedure.

2. A process as defined in claim 1, wherein the pipe (1) is wound with a circumference length that differs from the circumferential nominal value by an amount of tolerance, so that marks (4) deviate from the alignment line (6) only on one side, the found time differences initiating corrective processes that in each instance are effective exclusively in the same direction.

3. A process as defined in claim 1 wherein a time difference, which deviates from the nominal value zero, between the mark recognition signals of two paraxially aligned check points (9,9') of the stationary checking field is determined.

4. A process as defined in claim 3 wherein each mark-recognition signal is generated by scanning a modified surface characteristic.

5. A process as defined in claim 3 wherein each mark-recognition signal is generated by a change in the reflection of light waves that impinge on the marks (4).

6. A process as defined in claim 1 wherein a time difference, which deviates from a prescribed nominal value, between two mark recognition signals of a single check point (9) of the stationary checking field is determined, the prescribed nominal value being defined by the circumference nominal value.

7. A process as defined in claim 6, wherein each mark-recognition signal is generated by scanning a modified surface characteristic.

8. A process as defined in claim 6, wherein each mark-recognition signal is generated by a change in the reflection of light waves that impinge on the marks (4).

9. A process as defined in claim 1, wherein the band of material (3) is marked by impression, by being punched, or by paint.

10. An apparatus for producing a helically seamed pipe comprising:

a guide table (18) for the incoming band of material (3) which has a marking device (7), with a winding apparatus (10) that comprises a pipe guide and, in particular, bending rollers (14), and with means (13) for initiating corrective procedures if the circumference length (u) of the resulting pipe (1) changes, wherein the guide table (18) has an apparatus (11) for the variable adjustment of the distance (a) between the marks (4), that at least one checking system (8) for emitting mark recognition signals is provided in the area of the pipe guide of the winding apparatus (10), and that for the recognition of changes in the circumference length (u) a device (24, 25) for the detection of a time difference between two mark recognition signals is provided, the means (13) for initiating the corrective procedures being associated with said device.

11. An apparatus as defined in claim 10, wherein the apparatus (11) for adjusting the distance between the marks (4) comprises a sensor that can be displaced along the band of material (3), and which, when it identifies a mark (4) initiates the formation of the next mark (4) by the marking apparatus (7).

12. An apparatus as defined in claim 10, wherein in the area of the pipe guide, the checking apparatus (8) has at least two check points (9, 9') that are on a paraxial alignment line (6) and are separated by a distance that equals the width of the band of material (3).

13. An apparatus as defined in claim 10, wherein a stamp (16) is provided as the marking apparatus (7).

* * * * *